United States Patent [19]

Kitchen et al.

[11] 4,285,080

[45] Aug. 25, 1981

[54] SPRING DECK FOR SEATING STRUCTURES

[75] Inventors: John P. Kitchen, Georgetown; Neville L. Riddle, Lexington, both of Ky.

[73] Assignee: Hoover Universal, Inc., Saline, Mich.

[21] Appl. No.: 95,459

[22] Filed: Nov. 19, 1979

[51] Int. Cl.[3] ..... A47C 17/13

[52] U.S. Cl. ..... 5/186 R; 5/13; 428/192

[58] Field of Search ..... 5/13, 186, 190, 191; 428/192; 150/1; 297/457

[56] References Cited

U.S. PATENT DOCUMENTS

| | | | |
|---|---|---|---|
| 264,753 | 9/1882 | Raudenbush | 5/186 R |
| 3,165,356 | 1/1965 | Geier et al. | 5/190 |
| 3,380,082 | 4/1968 | Mikos | 5/13 |
| 3,470,928 | 10/1969 | Schwartz | 428/192 |
| 4,176,414 | 12/1979 | Wright et al. | 5/13 |

*Primary Examiner*—Casmir A. Nunberg

*Attorney, Agent, or Firm*—Olsen and Stephenson

[57] ABSTRACT

A spring deck for supporting padding material in seating structures in which an open rigid frame is covered by a sheet of polypropylene fabric so as to provide both a cover for the frame and spring means to accommodate yieldingly loads that are applied to the surface of the sheet.

3 Claims, 3 Drawing Figures

SPRING DECK FOR SEATING STRUCTURES

REFERENCE TO RELATED APPLICATION

This application relates to pending application Ser. No. 043,148, filed May 29, 1979, for "Sofa Sleeper With Polypropylene Deck Assembly", and assigned to the assignee of this application.

BACKGROUND OF THE INVENTION

The present invention relates to a spring deck for supporting padding material in seating structures.

It is conventional practice in seating structures of this character to use decks formed of wire springs that function as a yieldable support for cushions or other padding. While wire spring decks have some desirable features, it is often necessary to provide fabric overdecking for the wire.

Accordingly, there is a need for an improved spring deck which will overcome the inadequacies of the conventional spring deck structures that have been used previously in seating. Efforts have been made to meet this need, such as is demonstrated by the spring deck that is disclosed in U.S. Pat. No. 4,136,410, patented Jan. 30, 1979 in the names of Vandenbark et al. In this spring deck, a wire fabric sheet is provided which merely modifies conventional wire link fabric, but would still require fabric overdecking.

SUMMARY OF THE INVENTION

The present invention has overcome the inadequacies of the prior art, and provides a spring deck for seating structures wherein a sheet material constructed principally of polypropylene fibers is used as both the spring material and the overdecking. The polypropylene fiber fabric sheet can be constructed according to the teachings found in the aforesaid pending application, Ser. No. 043,148.

In the present form of the invention, the deck has an open rigid frame having generally parallel front and rear rails. A sheet substantially covers the frame and has opposite front and rear edges, the sheet being constructed principally of polypropylene fibers. First means connect one edge of the sheet unyieldingly to one rail along the length thereof and second means connect the opposite edge of the sheet yieldingly to the other rail along the length thereof so as to maintain the sheet in a substantially taut position as it covers the frame, but allowing desirable yielding when loads are applied to the sheet.

Preferably, the sheet has embedded in each of its front and rear edges of border wire extending lengthwise thereof, as is disclosed in the aforesaid pending application, and the first and second means are connected respectively to the border wires. The first connecting means may be staples that connect the associated border wire directly to one rail of the frame, and the second connecting means may be coil springs that are connected at one of their respective ends to the other associated border wire and staples that then connect the other of the ends of the coil springs directly to the other rail of the frame.

Thus, there is formed a spring deck which performs a double function, namely, serving first to provide desired spring properties and second to provide an attractive cover that is constantly maintained taut and smooth over the frame. At the same time, the undesirable properties associated with the prior art are eliminated.

DESCRIPTION OF THE PREFERRED EMBODIMENT

Figure 1:
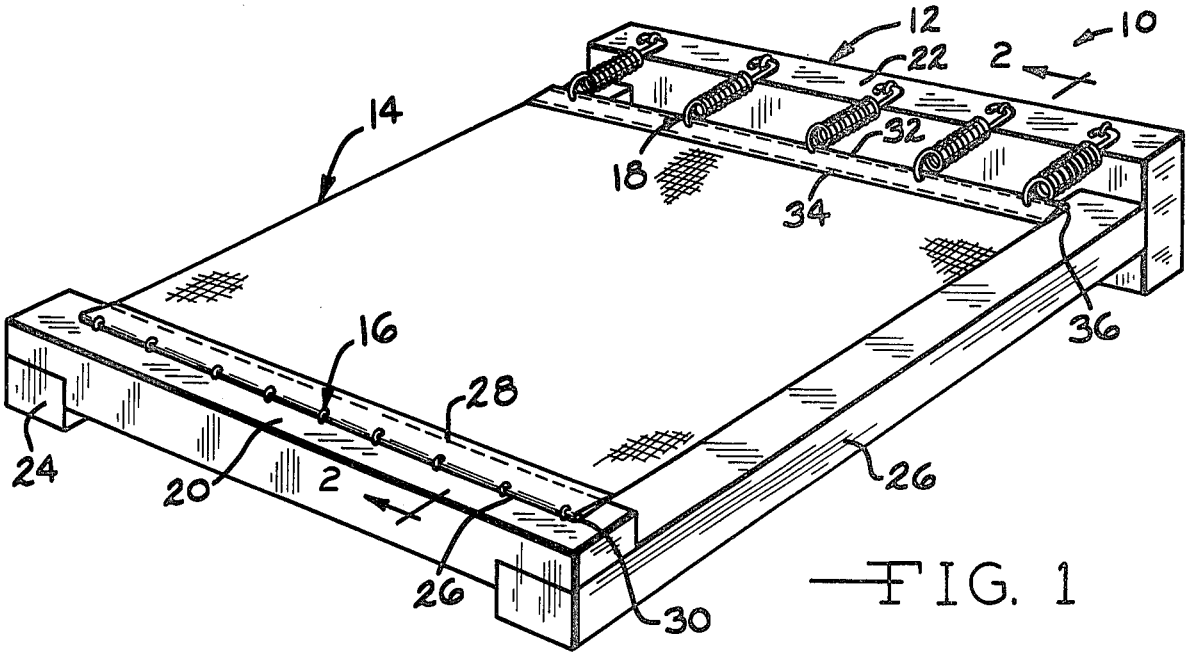
FIG. 1 is a perspective view of a spring deck embodying one form of the invention for supporting padding material in seating structures.

Referring now to the drawings, the invention will be described in greater detail. The spring deck 10 which embodies the invention comprises an open rigid frame 12, a sheet 14 and first and second means 16 and 18 respectively for connecting the sheet 14 to the open frame 12.

The open frame 12 is a rigid structure having generally parallel front and rear rails 20 and 22, respectively, which are supported in generally parallel relationship between side members 24 and 26.

The sheet 14 is made of a polypropylene fabric which is stitched at its front or one edge 26 so that it has an edge seam 28 in which is enclosed or embedded a border wire 30. The sheet 14 has a similar second or rear edge 32 which is stitched to form a seam at 34 in which is enclosed another border wire 36.

Figure 2:
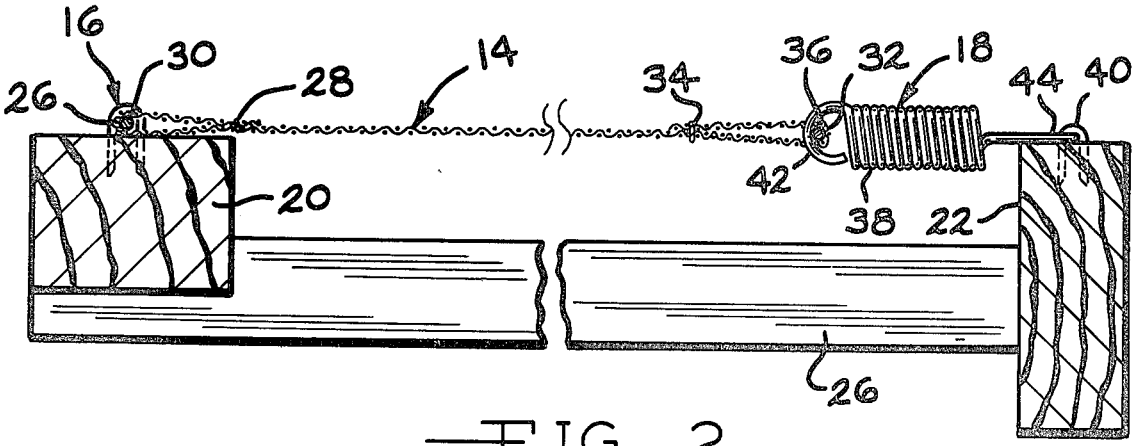
FIG. 2 is a fragmentary section taken on the lines 2—2 of FIG. 1.
Figure 3:
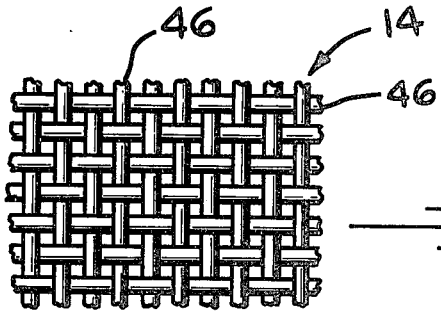
FIG. 3 is an enlarged fragmentary plan view of the polypropylene fabric from which the sheet of the present invention is constructed.

The first means 16 are staples which connect the border wire 30 unyieldingly to the front or one rail 29 along the entire length of the edge 26. The second means 18 includes the coil springs 38 and the staples 40 which connect the border wire 36 and thereby the second or rear edge 32 yieldingly to the second or rear rail 22. As can be seen best in FIG. 2, each of the coil springs 38 has its one end 42 connected to the border wire 36 and the staples 40 connect the other end 44 of the coil springs to the rail 22. The open rigid frame 12, the sheet 14, and the first and second connecting means 16 and 18 are constructed and arranged so as to maintain the sheet 14 in a substantially taut position as it substantially covers the frame 12. As can be seen in FIG. 3, the sheet 14 is constructed by weaving a plurality of polypropylene fibers or yarns 46 which have been heat treated so that they can be stretched when subjected to certain stress, but when the stress is removed, will return to their original sizes. Polypropylene yarns of this type are conventional and are described in U.S. Pat. No. 3,470,928, to which reference is made for a more complete description.

In the use of the spring deck 10 for supporting padding material in seating structures, the polypropylene sheet 14 is in a generally horizontal position and is in a relatively taut condition so that it will provide the desired yieldable support for the conventional padding material in seating structures. When loads are applied to the padding material, the sheet 14 will stretch slightly to accommodate localized loads, and the second connecting means 18 will similarly yield in a fore-and-aft direction to accommodate the loads, but when the loads are removed, the sheet will return to its original taut condition.

Because the sheet 14 is a non-metallic fabric, it functions both as a supporting spring structure and as a cover or overdecking for the open rigid frame 12. When the sheet 14 functions as a cover or overdecking, it provides the necessary yieldable support for padding material supported thereon without imprinting a design on the padding material as is the case with conventional wire fabric. The construction and arrangement of the components of the invention is such that it can be rapidly assembled at low cost and without the problems associated with handling and installing conventional wire fabric sheet material or wire springs. The mounting of the sheet 14 so that the forward portion of the sheet 14 adjacent the front rail 20 can stretch because it is formed of polypropylene fibers, but not move because the front of the sheet 14 is fixed by the staples 16 to the front rail 20, while the rear portion, adjacent the rear rail 22, can both stretch and move, because of the spring mounting, enables the sheet 14 to provide the desired yieldable resistance to seating loads that is associated with seating comfort.

It is claimed:

1. A spring deck for supporting padding material in seating structures, said deck comprising an open rigid frame having generally front and rear rails, a sheet substantially covering said frame and having opposite front and rear edges, said sheet being constructed principally of woven, heat treated polypropylene fibers, and first means fixing one edge of said sheet to one rail along the length thereof and second means movably connecting the opposite edge of said sheet to the other rail along the length thereof so as to maintain said sheet in a substantially taut position as it substantially covers said frame.

2. A spring deck according to claim 1, wherein said sheet has embedded in each of its front and rear edges a border wire extending lengthwise thereof, and said first and second means are connected respectively to the border wires of said edges.

3. A spring deck according to claim 2, wherein said first means includes staples that connect the border wire of said one edge to said front rail, and said second means includes coil springs that are connected to the border wire of said other edge and staples that connect said coil springs to said rear rail.

* * * * *